US011751308B2

(12) United States Patent
Bell

(10) Patent No.: US 11,751,308 B2
(45) Date of Patent: Sep. 5, 2023

(54) ISOLATED DRIVER FOR LIGHTING MEANS

(71) Applicant: Tridonic GmbH & Co KG, Dornbirn (AT)

(72) Inventor: Wayne Bell, Broompark (GB)

(73) Assignee: Tridonic GmbH & Co KG, Dornbirn (AT)

( * ) Notice: Subject to any disclaimer, the term of this patent is extended or adjusted under 35 U.S.C. 154(b) by 0 days.

(21) Appl. No.: 17/780,399

(22) PCT Filed: Dec. 16, 2020

(86) PCT No.: PCT/EP2020/086569

§ 371 (c)(1),
(2) Date: May 26, 2022

(87) PCT Pub. No.: WO2021/130090

PCT Pub. Date: Jul. 1, 2021

(65) Prior Publication Data

US 2023/0026746 A1 Jan. 26, 2023

(30) Foreign Application Priority Data

Dec. 23, 2019 (EP) ..... 19219212

(51) Int. Cl.
*H05B 45/30* (2020.01)
*H05B 45/382* (2020.01)
*H05B 45/36* (2020.01)

(52) U.S. Cl.
CPC ..... *H05B 45/382* (2020.01); *H05B 45/36* (2020.01)

(58) Field of Classification Search
CPC .... H05B 45/37; H05B 45/325; H05B 45/355; H05B 45/382; H05B 45/385; H05B 45/3725
See application file for complete search history.

(56) References Cited

U.S. PATENT DOCUMENTS 8,587,221 B2 * 11/2013 Liu ..... H05B 45/3725 315/307
9,320,118 B2 * 4/2016 Gruber ..... H05B 47/18
(Continued)

FOREIGN PATENT DOCUMENTS

WO 2012/028787 3/2012
WO 2018/099630 6/2018
WO 2020254003 A1 12/2020

OTHER PUBLICATIONS

PCT/EP2020/086569, International Search Report dated Feb. 9, 2021, 3 pages.

(Continued)

*Primary Examiner* — Tung X Le

(74) *Attorney, Agent, or Firm* — Andrus Intellectual Property Law, LLP

(57) ABSTRACT

The invention relates to an isolated driver (100) for lighting means (109), comprising: a primary circuit (100*a*), a secondary circuit (100*b*), an isolation barrier (106) separating the primary circuit (100*a*) and the secondary circuit (100*b*), wherein a ground potential of the primary circuit (100*a*) and a ground potential of the secondary circuit (100*b*) are connected via a capacitor (107), and a control circuit (111) on the secondary side (100*b*), monitoring a current to/from the capacitor (107) to the ground potential of the secondary circuit (100*b*) and issuing a mains (101) failure signal in case the current does not meet predefined conditions, preferably in case no such current is detected.

13 Claims, 2 Drawing Sheets

(56) References Cited

U.S. PATENT DOCUMENTS

| | | | | |
|---|---|---|---|---|
| 9,537,407 | B2 * | 1/2017 | Fang | H05B 45/385 |
| 10,320,303 | B1 * | 6/2019 | Xiong | H02M 1/4225 |
| 2013/0015777 | A1 | 1/2013 | De Anna et al. | |
| 2013/0162158 | A1 * | 6/2013 | Pollischansky | H05B 45/38 315/201 |
| 2015/0109832 | A1 * | 4/2015 | Heo | H02M 3/33507 363/21.18 |
| 2015/0214785 | A1 * | 7/2015 | Jagjitpati | H02J 9/065 307/66 |
| 2022/0086978 | A1 * | 3/2022 | Archer | H05B 45/382 |
| 2022/0361304 | A1 * | 11/2022 | Wang | H02M 1/44 |

OTHER PUBLICATIONS

Cantrell, "AN-0971, Application Note: Recommendations for Control of Radiated Emissions with isoPower Devices", Analog Devices, Rev. C, Jan. 30, 2014, pp. 1-20.

Kennedy et al., AN-1109 Application Note: Recommendations for Control of Radiated Emissions with iCoupler Devices, Analog Devices, Rev. 0, Apr. 13, 2011, pp. 1-20.

Silicon Laboratores, Inc., "AN1131: Design Guide for Reducing Radiated and Conducted Emissions in Isolated Systems Using Skyworks' Isolators", Nov. 30, 2019, p. 23, 24.

EP19219212.8, European Search Report, dated Jan. 25, 2023, 12 pages.

* cited by examiner

ISOLATED DRIVER FOR LIGHTING MEANS

CROSS REFERENCE TO RELATED APPLICATIONS

The present application is the U.S. national stage application of international application PCT/EP2020/086569 filed Dec. 16, 2020, which international application was published on Jul. 1, 2021 as International Publication WO 2021/130090 A1. The international application claims priority to European Patent Application No. 19219212.8 filed Dec. 23, 2019.

TECHNICAL FIELD OF THE INVENTION

The invention relates to lighting means with functionality for the case of an emergency condition, and drivers for driving an emergency light and, in particular, concerns an isolated driver, e.g. in flyback or boost topology, implementing an isolation barrier.

BACKGROUND OF THE INVENTION

An emergency lighting system may use a battery-backed lighting device which switches to a battery automatically when a power failure is detected. Such battery may be connected to a driver as individual system and/or may be connected to a central point of the electrical energy supply.

An emergency light is necessary in order to provide illumination when the power provided by regular power supply, e.g. mains supply, fails. Emergency lighting devices require a kind of energy storage device, for example a battery, such as a rechargeable battery, which provides electrical energy to the lighting device, during the mains failure.

Modern emergency lighting devices can be provided in commercial buildings and residential buildings. The lighting devices often include one or more clusters of high-intensity LEDs.

The battery may be connected directly to an emergency driver. In such case the emergency driver switches over the energy supply to power the lighting means from the mains supply to the battery supply. Such system are often called local emergency systems.

The battery may be connected to a central point of the electrical energy supply. In such case there may be a central emergency supply unit which powers the mains network for a certain area (e.g. the supply lines for a room or building) with energy powered by the central battery. In such case the lighting devices with emergency functionality may switch the light output to a predefined level in order to save energy and to provide emergency illumination at the same time. The voltage provided by the central battery system may be a DC voltage or a rectified AC voltage.

A conventional emergency lighting device driver supplied by a mains voltage can comprise an electromagnetic interference EMI filter circuit followed by a power factor correction circuit (PFC), which supplies a converter circuit, for example a flyback converter, which powers LEDs used as lighting devices. The flyback converter can also separate the mains supply on one hand and a low voltage side on the other hand by means of an isolation barrier.

The isolation barrier provides safety extra-low voltage (SELV—also separated extra-low voltage) by separating circuitry with high voltages, e.g. a mains supply voltage, from circuitry with low voltages. A SELV circuit can include electrical-protective isolation (double insulation) from all circuits other than SELV, particularly all circuits that may carry higher voltages and simple separation from other SELV circuits.

State of the art lighting devices make use of specific additional discrete components designed to provide a means for detection for mains presence or status in order that an ASIC or microcontroller uC can use this information. This is particularly critical in emergency control gear as this detection is often used to switch to the battery supply for an emergency event (such as loss of mains), to change the light output to a predefined level and/or to transmit an information about a mains failure or emergency event to other devices. Particularly in emergency drivers with a flyback or resonant halfbridge topology this detection can be relatively slow if implemented on the secondary side.

Thus, it is an object of the present invention to provide for an improved isolated driver for lighting means.

SUMMARY OF THE INVENTION

The object of the present invention is achieved by the solution provided in the enclosed independent claims. Advantageous implementations of the present invention are further defined in the dependent claims.

According to a first aspect, the invention relates to an isolated driver for lighting means, comprising: a primary circuit, a secondary circuit, an isolation barrier separating the primary circuit and the secondary circuit, wherein a ground potential of the primary circuit and a ground potential of the secondary circuit are connected via a capacitor, and a control circuit on the secondary side, monitoring a current to/from the capacitor to the ground potential of the secondary circuit and issuing a mains failure signal in case the current does not meet predefined conditions, preferably in case no such current or a certain change in such current is detected.

The capacitor bridging the isolation stage is dimensioned to be within regulatory requirements for SELV barriers.

This provides the advantage that instead of using extra discrete circuitry specifically for the purpose of detecting a mains failure, the same result can be achieved almost instantly by the use of an existing capacitor, for example a class Y capacitor, connected across the SELV barrier together with a resistor or bead used for EMI purposes. Moreover, physical space is used efficiently and costs are reduced. Moreover, embodiments of the invention allow for a fast and reliable mains detection without the need for specific circuitry to do so. It can use existing circuitry that is present on SELV rated emergency drivers and only simple signal processing circuitry may be needed to allow secondary control.

In an embodiment of the isolated driver according to the first aspect, the mains failure signal causes the activation of an emergency lighting operation stage supplying an emergency lighting means.

This provides the advantage that a very fast mains detection of both mains presence and mains loss is made possible.

In an embodiment of the isolated driver according to the first aspect, a shunt resistor is connected in series between the capacitor and the ground potential of the secondary circuit.

Advantageously, components are saved since the same components are used for doing multiple tasks. Furthermore, cost are minimised and the very fast detection of mains present and mains loss allows to provide lighting in emergency devices in a very fast and efficient way.

In an embodiment of the isolated driver according to the first aspect, the mains voltage is connected to an electromagnetic interference, EMI, filter on the primary side circuit.

In an embodiment of the isolated driver according to the first aspect, the EMI filter is connected to a full- or half-bridge, wherein the full- or half-bridge is connected to the ground potential of the primary circuit.

In an embodiment of the isolated driver according to the first aspect, the full- or half-bridge is connected to a primary side switching circuit and wherein the primary side switching circuit is connected to the capacitor.

In an embodiment of the isolated driver according to the first aspect, the isolation barrier is a safety extra-low-voltage, SELV, barrier.

In an embodiment of the isolated driver according to the first aspect, the capacitor is a class Y capacitor.

In an embodiment of the isolated driver according to the first aspect, the control circuit is further configured to measure an amplitude of the mains voltage.

In an embodiment of the isolated driver according to the first aspect, the control circuit is further configured to derive a timing signal with regard to a frequency of the mains voltage.

According to a second aspect, the invention relates to a method for operating an isolated driver for lighting means, comprising: separating a primary circuit and a secondary circuit, wherein a ground potential of the primary circuit and a ground potential of the secondary circuit are connected via a capacitor, monitoring a current to/from the capacitor to the ground potential of the secondary circuit, and issuing a mains failure signal in case the current does not meet predefined conditions, preferably in case no such current is detected.

BRIEF DESCRIPTION OF THE DRAWINGS

The invention will be explained in the followings together with the figures.

DETAILED DESCRIPTION OF THE PREFERRED EMBODIMENTS

Figure 1:
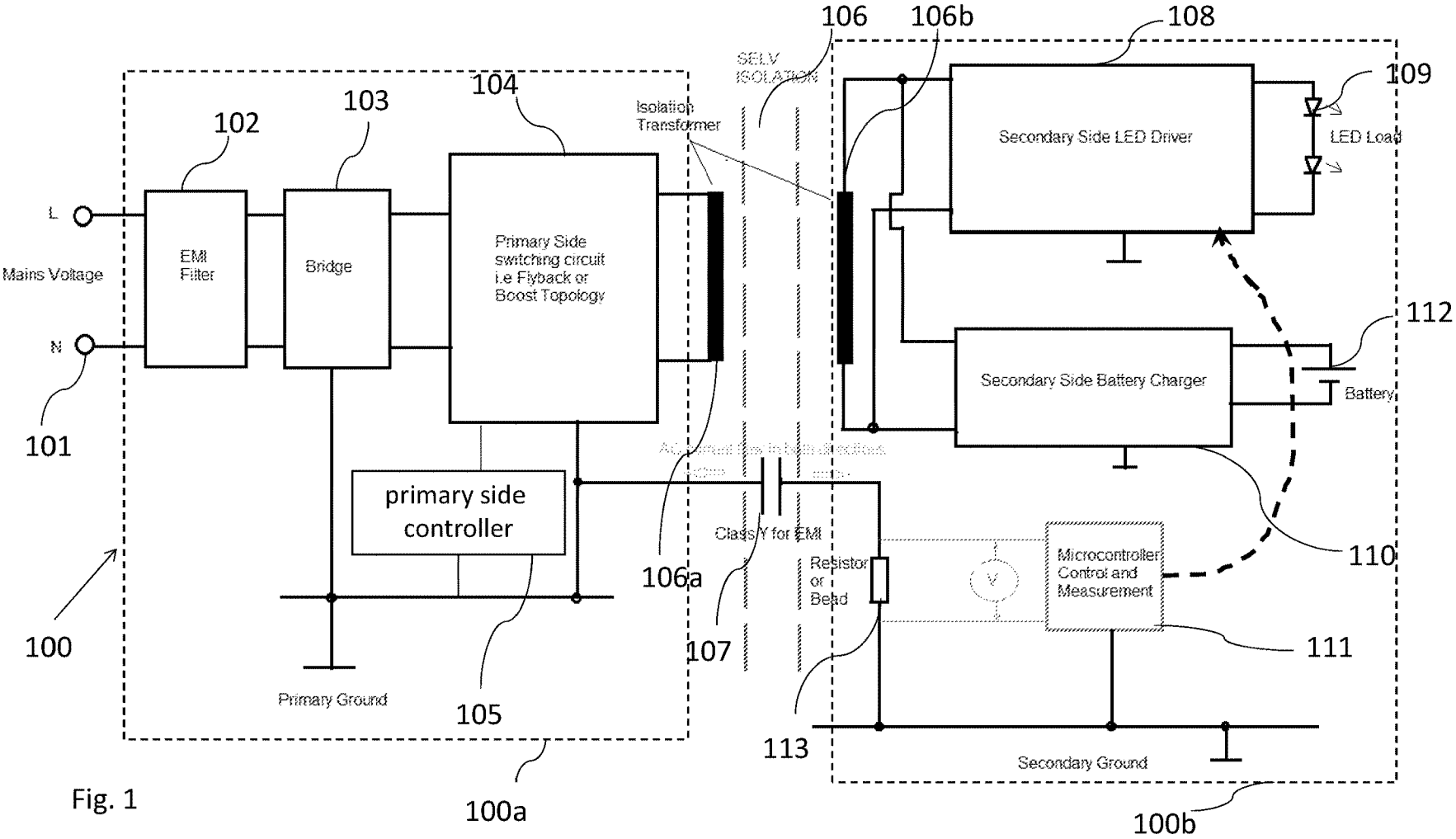
FIG. 1 shows an isolated driver for lighting means according to an embodiment.

Aspects of the present invention are described herein in the context of an isolated driver for lighting means.

The present invention is described more fully hereinafter with reference to the accompanying drawings, in which various aspects of the present invention are shown. This invention however may be embodied in many different forms and should not be construed as limited to the various aspects of the present invention presented through this disclosure. Rather, these aspects are provided so that this disclosure will be thorough and complete, and will fully convey the scope of the present invention to those skilled in the art. The various aspects of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus.

Various aspects of an isolated driver for lighting means will be presented. However, as those skilled in the art will readily appreciate, these aspects may be extended to aspects of an isolated drivers for lighting means without departing from the invention.

The term "LED luminaire" shall mean a luminaire with a light source comprising one or more LEDs. LEDs are well-known in the art, and therefore, will only briefly be discussed to provide a complete description of the invention.

It is further understood that the aspect of the present invention might contain integrated circuits that are readily manufacturable using conventional semiconductor technologies, such as complementary metal-oxide semiconductor technology, short "CMOS". In addition, the aspects of the present invention may be implemented with other manufacturing processes for making optical as well as electrical devices. Reference will now be made in detail to implementations of the exemplary aspects as illustrated in the accompanying drawings. The same references signs will be used throughout the drawings and the following detailed descriptions to refer to the same or like parts.

Now referring to FIG. 1, an isolated driver 100 for lighting means 109 is shown according to an embodiment. The isolated driver 100 may be formed by an isolated primary side switched driver or an isolated secondary side switched driver or a combination of both. The driver may implement e.g. a flyback, resonant halfbridge or boost topology.

The isolated driver 100 for lighting means 109 comprises a primary circuit 100*a* preferably having at least one actively controlled switch in series to a primary side winding, a secondary circuit 100*b*, an isolation barrier 106 having said primary side winding and a secondary side winding, and separating the primary circuit 100*a* and the secondary circuit 100*b*. A ground potential of the primary circuit 100*a* and a ground potential of the secondary circuit 100*b* are connected via a capacitor 107.

Moreover, the driver 100 comprises a control circuit 111 on the secondary side 100*b*, monitoring a current to/from the capacitor 107 to the ground potential of the secondary circuit or side 100*b* and issuing a mains failure signal in case the current does not meet predefined conditions, preferably in case no such current is detected.

The mains failure signal may e.g. cause starting the operation of the lighting means off the battery power.

The switch on the primary side is preferably controlled by a primary-side control circuit which may perform a feedback-control of a secondary side current or voltage, using a feedback signal obtained at the primary side or the secondary side.

The control circuit 111 may control e.g. a converter for driving the LEDs off the battery power.

The control circuit 111 may be connected to a wired or wireless dimming interface and may receive dimming information.

This provides the advantage that instead of using extra discrete circuitry specifically for this purpose, the same result can be achieved almost instantly by the use of an existing capacitor 107, for example a class Y capacitor, connected across the SELV barrier 106 together with a resistor or bead used for EMI purposes.

Furthermore, the primary side 100*a* comprises an EMI filter 102 supplied by the mains 101 voltage, a bridge 103, the primary side switching circuit 104 and preferably a primary side controller 105. The primary side controller 105 can be configured to control the primary side switching circuit 104. The bridge 103 can be a half- or full-bridge.

The secondary side 100*b* comprises a secondary LED driver 108 configured to drive the LED load 109. Moreover, a battery 112 can be provided which is charged by a secondary side battery charger 110 and which is configured to supply the LED load 109 in case of a mains 101 failure.

The control circuit 111 may also control the primary side switching circuit 104, for example by a control path crossing the isolation barrier, for instance via an transformer or optocoupler. In such case the control circuit 111 may take over functions from the primary side controller 105.

Embodiments of this invention make use of existing EMI improvement techniques such as class Y capacitors and series resistor/bead between primary 100*a* and secondary circuits 100*b*) to, then, measure a voltage on the secondary side 100*b* due to the residual current flow through the class Y capacitor. The AC current can be rectified and filtered, if necessary, to provide a DC voltage to the secondary side control circuit 111, e.g. formed by a microcontroller for example. This current only flows when the mains 101 is present and stops flowing when the mains 101 fails. The amount of current is directly proportional to the mains voltage level.

This provides the advantage that use is made of existing circuitries, in particular capacitor 107, to provide a second function directly without the need for a separate circuit. Moreover, physical space is used efficiently and costs are reduced. For instance the capacitor 107 may form a part of the EMI filter 102.

Moreover, embodiments of the present invention allow for a very fast mains detection (both mains presence and mains loss). Moreover, advantageously, components are saved since the same components are used for doing multiple things. Furthermore, cost are minimised and the very fast detection of mains present and mains loss allows to provide lighting in emergency devices in a very fast and efficient way.

Moreover, embodiments of the invention allow for a fast and reliable mains detection without the need for specific circuitry. It can use existing circuitry that is present on SELV rated emergency drivers and only simple signal processing circuitry may be needed to allow secondary control.

Thus, in case mains voltage is present at the primary side 100*a*, an AC current will flow through the class Y capacitor 107 across the SELV-isolation barrier 106. Therefore, when arranging a resistor or bead 113 on the secondary side 100*b*, through which this AC current is directed to flow, the voltage drop across this resistor or bead 113 can be used in order to analyze the mains voltage (indirectly) with regard to at least one of the following aspects:

- presence or non-presence of AC voltage at the primary side 100*a* (especially important for emergency drivers);
- presence or non-presence of DC voltage at the primary side 100*a* (especially important for emergency drivers),
- presence or non-presence of a rectified AC voltage at the primary side 100*a* (especially important for emergency drivers),
- measuring the amplitude of the mains voltage, as the AC current is proportional to the amplitude of the AC mains voltage level, and/or deriving a timing signal with regard to the frequency of the mains voltage.

Therefore, in embodiments of the present invention, no dedicated (primary side 100*a*) mains detection circuitry is required, but rather the presence of the already present class Y capacitor 107 across the SELV-isolation barrier 106 can be used for the mains voltage detection.

Figure 2:
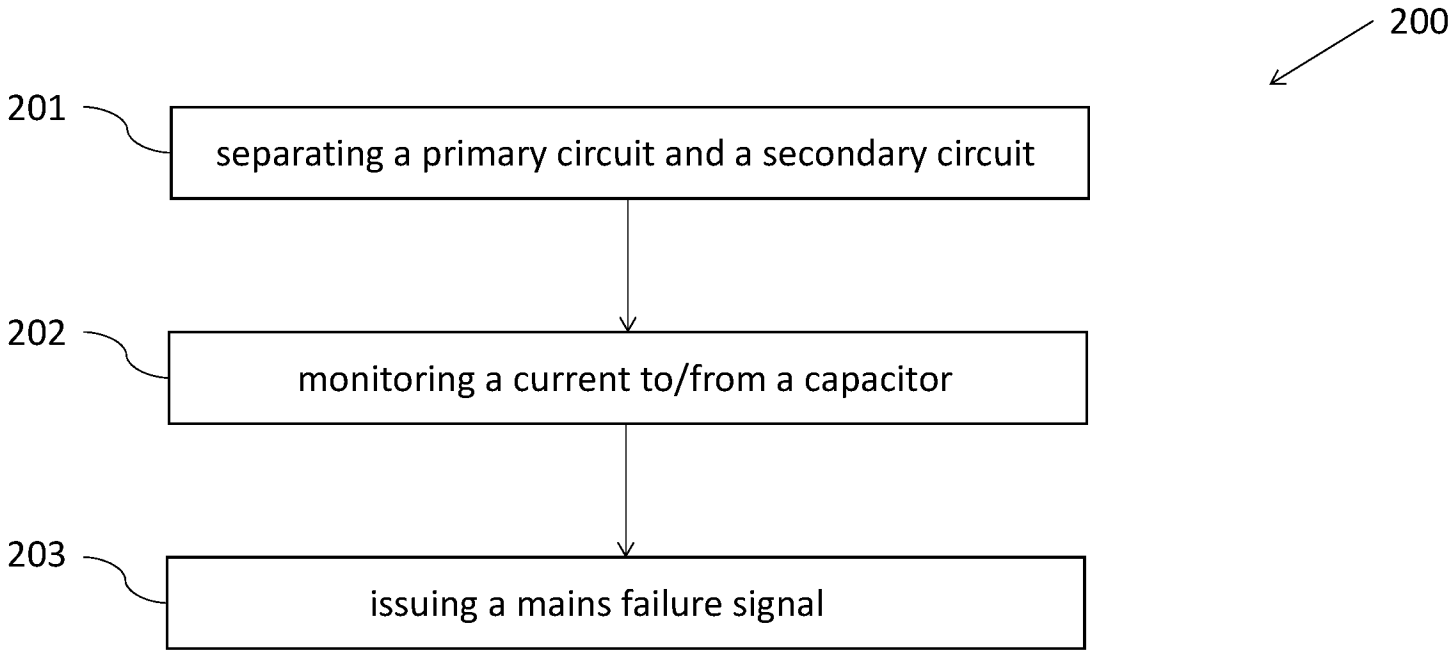
FIG. 2 shows a method for operating an isolated driver for lighting means according to an embodiment.

FIG. 2 shows a method 200 for operating an isolated driver for lighting means 100 according to an embodiment.

The method 200 comprises the steps of:

- separating 201 a primary circuit 100*a* and a secondary circuit 100*b*, wherein a ground potential of the primary circuit 100*a* and a ground potential of the secondary circuit 100*b* are connected via a capacitor 107;
- monitoring 202 a current to/from the capacitor 107 to the ground potential of the secondary circuit 100*b*; and
- issuing 203 a mains failure signal in case the current does not meet predefined conditions, preferably in case no such current or a certain change in such current is detected.

All features of all embodiments described, shown and/or claimed herein can be combined with each other.

While various embodiments of the present invention have been described above, it should be understood that they have been presented by way of example only and not limitation. Numerous changes to the disclosed embodiments can be made in accordance with the disclosure herein without departing from the spirit of scope of the invention. Thus, the breadth and scope of the present invention should not be limited by any of the above-described embodiments. Rather, the scope of the invention should be defined in accordance with the following claims and their equivalence.

Although the invention has been illustrated and described with respect to one or more implementations, equivalent alternations and modifications will occur to those skilled in the art upon the reading of the understanding of the specification and the annexed drawings. In addition, while a particular feature of the invention may have been disclosed with respect to only of the several implementations, such features may be combined with one or more other features of the other implementations as may be desired and advantage for any given or particular application.

The invention claimed is:

1. An isolated driver (100) for lighting means (109), comprising:

- a primary circuit (100*a*);
- a secondary circuit (100*b*);
- an isolation barrier (106) separating the primary circuit (100*a*) and the secondary circuit (100*b*), wherein a ground potential of the primary circuit (100*a*) and a ground potential of the secondary circuit (100*b*) are connected via a capacitor (107);
- a shunt resistor (113) connected in series between the capacitor (107) and the ground potential of the secondary circuit (100*b*); and
- a control circuit (111) on the secondary side (100*b*), monitoring a current to/from the capacitor (107) to the ground potential of the secondary circuit (100*b*) by monitoring the voltage drop across the shunt resistor (113) and issuing a mains (101) failure signal in case the current does not meet predefined conditions.

2. The isolated driver (100) of claim 1, wherein the mains failure signal causes the activation of an emergency lighting operation stage supplying an emergency lighting means.

3. The isolated driver (100) of claim 1, wherein the mains voltage (101) is connected to an electromagnetic interference, EMI, filter (102) on the primary side circuit (100*a*).

4. The isolated driver (100) of claim 3, wherein the capacitor (107) forms a part of the EMI filter (102).

5. The isolated driver (100) of claim 3, wherein the EMI filter (102) is connected to a full or half-bridge, wherein the full- or half-bridge is connected to the ground potential of the primary side circuit.

6. The isolated driver (100) of claim 5, wherein the full or half-bridge (103) is connected to a primary side switching circuit (104) and wherein the primary side switching circuit (104) is connected to the capacitor (107).

7. The isolated driver (100) of claim 1, wherein the isolation barrier (106) is a safety extra-low-voltage, SELV, barrier.

8. The isolated driver (100) of claim 1, wherein the capacitor (107) is a class Y capacitor.

9. The isolated driver (100) of claim 1, wherein the control circuit (111) is further configured to measure an amplitude of the mains voltage (101).

10. The isolated driver (100) of claim 1, wherein the control circuit (111) is further configured to derive a timing signal with regard to a frequency of the mains voltage (101).

11. The isolated driver (100) of claim 1 wherein said predefined conditions comprise either no detected current or a certain change in detected current.

12. A method (200) for operating an isolated driver (100) for lighting means (109), comprising:

separating (201) a primary circuit (100*a*) and a secondary circuit (100*b*), wherein a ground potential of the primary circuit (100*a*) and a ground potential of the secondary circuit (100*b*) are connected via a capacitor (107);

providing a shunt resistor (113) connected in series between the capacitor (107) and the ground potential of the secondary circuit (100*b*);

monitoring (202) a current to/from the capacitor (107) to the ground potential of the secondary circuit (100*b*) by monitoring the voltage drop across the shunt resistor (113); and issuing (203) a mains (101) failure signal in case the current does not meet predefined conditions.

13. The method of claim 12 wherein said predefined conditions comprise either no detected current or a certain change in detected current.

* * * * *